United States Patent [19]

Orofino

[11] 4,097,082

[45] Jun. 27, 1978

[54] SANITARY PICKUP DEVICE FOR ANIMAL FECES

[76] Inventor: Michael J. Orofino, 2 Brookside Dr., Baldwin, N.Y. 11510

[21] Appl. No.: 782,375

[22] Filed: Mar. 29, 1977

[51] Int. Cl.[2] ..... A01K 29/00

[52] U.S. Cl. ..... 294/19 R; 294/1 R

[58] Field of Search ..... 294/1 R, 19 R, 22, 50.8, 294/55, 100, 115; 15/104.8, 257.1, 257.6, 257.7; 56/332, 333, 334

[56] References Cited

U.S. PATENT DOCUMENTS

| | | | |
|---|---|---|---|
| 3,446,525 | 5/1969 | Jones | 294/19 R |
| 3,703,158 | 11/1972 | Lemler | 294/19 R X |
| 3,733,098 | 5/1973 | Tobias | 294/19 R |
| 3,802,728 | 4/1974 | Giacopelli | 294/1 R X |
| 3,912,316 | 10/1975 | Veech | 294/1 R X |

*Primary Examiner*—Johnny D. Cherry

*Attorney, Agent, or Firm*—Shoemaker and Mattare, Ltd.

[57] ABSTRACT

A device for picking up animal droppings in a completely sanitary manner. The device has an elastomeric-like band which is mounted thereon to automatically close over the mouth of a flexible wrapper to securely close that wrapper after pickup. The wrapper is doubled back over the elements of the device which effect the pickup motion to protect those elements from contact with the droppings. After the pickup has been completed, the securely closed wrapper is transported in the device to a suitable depository.

10 Claims, 8 Drawing Figures

SANITARY PICKUP DEVICE FOR ANIMAL FECES

BACKGROUND OF THE INVENTION

The present invention relates in general to article pickup devices, and, more particularly, to devices for the sanitary pickup of animal feces.

Many municipalities have laws and ordinances requiring animal owners to remove the feces left by their animals from public and private property. Furthermore, animal owners often desire to pick up animal droppings from an area wherein the animal is confined. Such removal requires the animal owner to pick up the feces and transport it to a suitable depository.

It is desirable to accomplish the pickup task in a sanitary manner so that the owner is not required to contact either the feces itself or any element of a pickup device which contacts that feces. It is also desirable to permit disposal of the feces in a securely wrapped manner.

There are many devices which permit one to pick up such feces and transfer that picked-up feces into a wrapper. However, all of these known devices have a similar deficiency, in that the wrapper used to contain the feces must be closed by hand, thereby requiring the user to come into contact with the wrapper. Any time one contacts an element which itself contacts the feces, the sanitary nature of the device is contravened.

The device embodying the teachings of the present invention enables one to pick up, wrap and transport articles such as animal droppings without contacting either the droppings or any element of the device which itself contacts the droppings.

SUMMARY OF THE INVENTION

The device embodying the teachings of the present invention enables one to pick up articles such as animal droppings from the ground in a completely sanitary manner.

The device embodying the teachings of the present invention includes a pair of blades pivotally mounted on a frame so that the bottom edges thereof can contact the ground and having a hinge on the top thereof. The hinge is connected to an operating rod which is spring loaded and is released by a hand-operated trigger mechanism to open the hinge. Opening the hinge causes the blades to tilt with respect to each other so that the bottom edges thereof are moved toward each other along an arc to effect a scraping movement which is directed inwardly of the device.

An elastomeric-like band, such as a rubber band, is positioned about the blades adjacent the bottom edges thereof, and a bumper is fastened to the frame to be super-adjacent the band. When the blades move through the arcuate path on the pickup stroke, the band abuts the bumper and the blades move out of that band. The bottom edges of the blades have rounded edges to allow the band to readily move off of the blades.

A flexible wrapper is positioned between the pickup blades and has an open mouth which is located between the blade lower edges. The wrapper is doubled back over the blade lower edges and over the band so that when the blades execute the closing, or pickup, motion, the wrapper inside surface contacts the feces and the wrapper thus protects the pickup device from contact with that feces.

The band snaps over the wrapper and closes same after the pickup is completed. The wrapper is thus securely closed and the user never need contact any element of the pickup device or wrapper which contacts the feces, and therefore use of the pickup device is entirely sanitary.

Because the device embodying the teachings of the present invention enables the wrapper to be automatically and securely closed, the operator is not required to hold or touch any element which may have contacted the excretement. As no part of the device contacts the excretement, the device is maintained in a sanitary condition and can thus be used, repaired and stored without any of the problems which are incident to an unsanitary device.

The device can be operated using only one hand, thereby freeing the user's other hand to hold a leash, or the like. Because of the action of the spring loaded operating rod, the user need not kneel, bend or stoop in order to gather the droppings together and pickup such droppings.

Once picked up, the droppings are securely held within a securely closed wrapper due to the action of both the spring loaded operating rod and the elastomeric-like band which is securely wrapped about the mouth of the wrapper. Furthermore, the device can be carried without having any of the contents exposed.

Once a suitable disposal position is reached, the device can be opened to deposit a securely closed wrapper therein without requiring the operator to contact the wrapper or any other element which may have contacted the excretement at some time.

The device can be manufactured in various sizes to accommodate animals of various sizes.

OBJECTS OF THE INVENTION

It is, therefore, a main object of the present invention to provide a pickup device which is entirely sanitary.

It is another object of the present invention to provide a pickup device which permits a wrapper to be automatically and securely closed.

It is a further object of the present invention to provide a pickup device which can be handled without contacting any element which has itself contacted animal droppings.

It is yet another object of the present invention to permit disposal of securely wrapped feces without requiring contact with any element which contacts that feces.

It is yet a further object of the present invention to provide a lightweight and easily carried pickup device.

It is still another object of the present invention to provide a pickup device which is sanitary for storage.

It is still a further object of the present invention to provide a pickup device which requires only one hand to operate.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
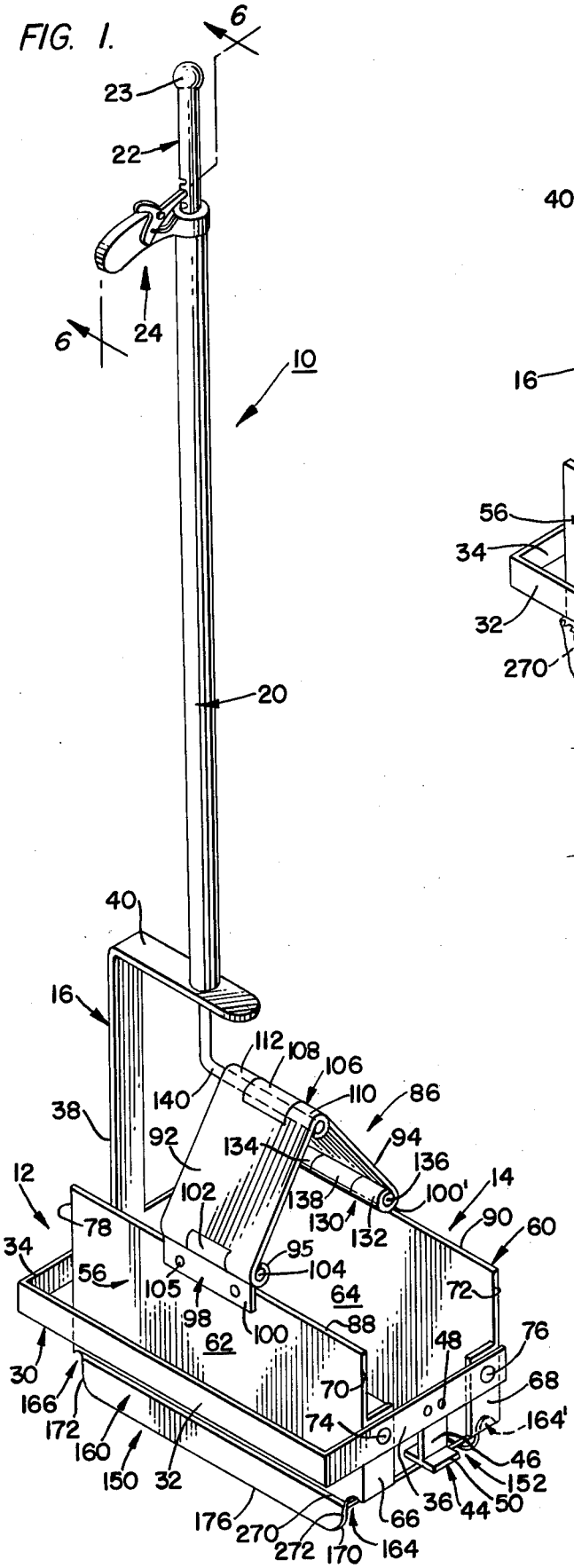
FIG. 1 is a perspective view of the device embodying the teachings of the present invention.

Shown in FIG. 1 is a device for picking up animal droppings or the like. The device is generally denoted by the numeral 10 and includes an integral frame member 12 supporting a pickup means 14 and having a bracket 16. A tubular sleeve 20 is endwise mounted at a lower end thereof on the bracket and an operating rod 22 having a knob 23 on an upper end thereof is slidably received in the tubular sleeve. A hand-gripped control means 24 is mounted on the tubular sleeve.

Figure 2:
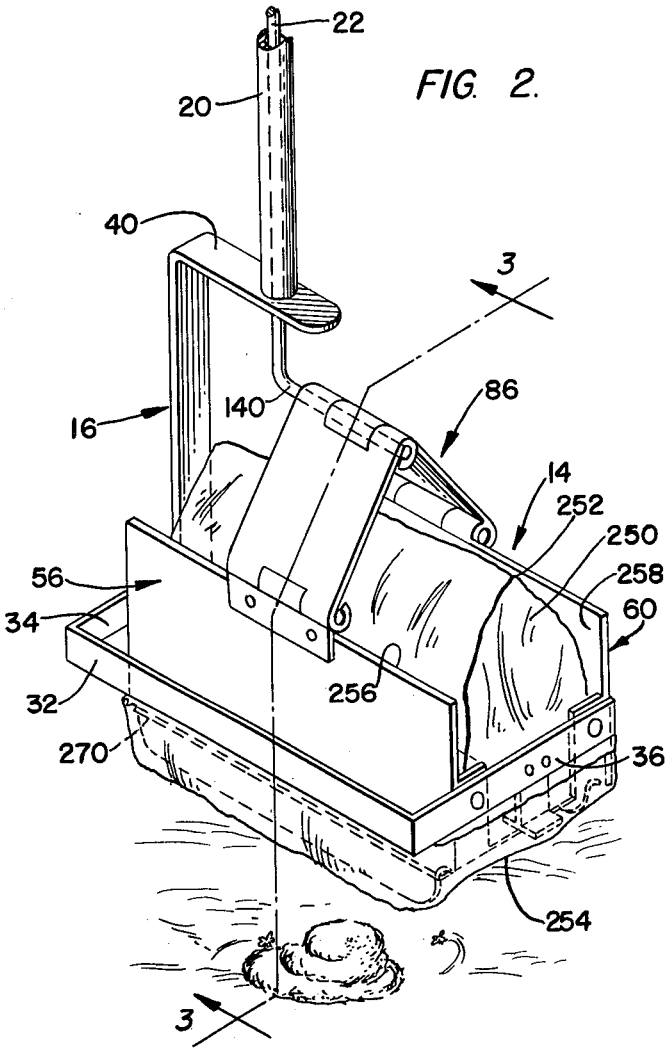
FIG. 2 is a perspective view of the device positioned for a pickup.

As shown in FIGS. 1 and 2, the frame 12 includes a brace 30 which is rectangularly shaped having longitudinal sides, such as lateral side 32, and transverse sides, such as first end 34 and second end 36. The bracket 16 includes an upstanding arm 38 integrally mounted at a lower end thereof on the brace end 34 and having on the upper end thereof a mounting arm extending inwardly and longitudinally of the frame. The arm 38 is preferably located medially of the end 34. A bumper 44 is dependently mounted on the other end 36 medially thereof.

The bumber 44 includes an elongate mounting arm 46 attached to end 36 by fastener 48 and depending therefrom and an elongate limit stop cross member 50 extending perpendicularly of the mounting arm to extend longitudinally of the frame. The purpose of the bumper will be explained below.

The pickup means 14 includes a pair of cooperating elongate, planar blades 56 and 60, each having a central portion 62 and 64. The blades are shown in FIG. 1 in the cocked or reposed position wherein they are facially opposed and may be in spaced parallelism. The blades are elongate and are co-extensive and have mounting ears 66 and 68 integrally attached thereto along first end edges 70 and 72 thereof. The ears extend inwardly of the pickup means toward each other to be perpendicular to the planes of the blades.

Figure 5:
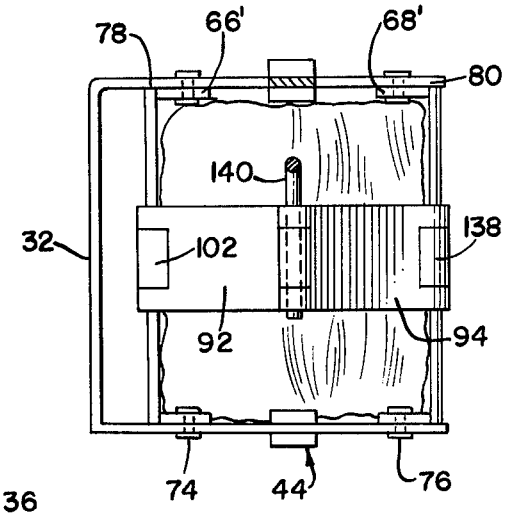
FIG. 5 is a plan view taken along line 5—5 of FIG. 3.

Fastener means 74 and 76 pivotally attach the ears to the frame end 34, thereby pivotally and tiltably attaching the blades to the frame. The other end edges 78 and 80 of the blades are also pivotally connected to the frame end 34 by ears 66' and 68' (FIG. 5). The fasteners are oriented to be medial of the blades along the transverse direction thereof.

A hinge 86 is surmounted on each blade at top side edges 88 and 90 thereof and includes elongate hinge arms 92 and 94. The hinge arm 92 has a pair of spaced apart fastening hooks, such as hook on one end thereof. A fastening hook mounting means 98 is attached to the blade 56 adjacent the top side edge thereof and includes a fastening flange 100 attached to the edge 88 and a hook 102 extending above the edge 88 to be received between the hinge hooks in an interdigitating manner to encircle a hinge bar 104 in a rotatable manner. Fasteners 105 attach the flange 100 to the blade adjacent the top side edge thereof.

A second fastening hook 106 is integrally attached to the other end of the hinge arm and interfits with a hook 108 on the other hinge arm 94. The hook 106 has a pair of spaced apart sections 110 and 112 and the hook 108 interdigitates therewith.

Hinge arm 94 has a hook section 130 including a pair of spaced apart sections 132 and 134 which encircle a hook engaging bar 136 in a rotatable manner similar to the attachment of the bar 104 to the lower hook section of arm 92. A hook section 138 extends outwardly from a mounting flange 100' to interdigitate between sections 132 and 134 of the hinge arm 94 and align therewith to receive the locking bar 136 in a manner which permits rotation of the hook sections 132 and 134 about the longitudinal axis of the bar.

The lower end of the operating rod 22 is angled to form a hinge rod 140 which is interfit through the interdigitated sections 108, 110 and 112 to couple the hinge arms together and to hingeably couple the blades together via the hinge 86.

The hinge arms thus depend downwardly and outwardly from the hinge rod 140 and the blades are therefore cantileveredly connected to the frame. The operating arm fits slidably through the mounting arm 40 and downward movement of the operating arm forces the hinge arms outwardly of each other, thereby forcing the blade top sides 88 and 90 outwardly away from each other. The pivotal connection of the blades on the frame thus causes the blades to tilt with respect to each other so that lower side edges 150 and 152 move arcuately toward each other so that the blades execute a pincer-like action.

The lower edges each include a bottom edge section, such as section 160, which is offset from the end edges 70 and 78 of the blade 56 to define notches 164 and 166.

The bottom edge sections have end edges 170 and 172 which are rounded in the plane of the blades to extend transversely of the bottom sections in an arcuate manner, and the notches 164 and 166 are arcuate. The ears 66 and 68 have lower end edges which are co-terminal with the end edges 70 and 72 of the blades which edges are offset from the blade lower side edges, such as edge 176. The purpose of the notches and bottom edge sections will be discussed below, and the above description also applies to ears 66' and 68'.

Figure 6:
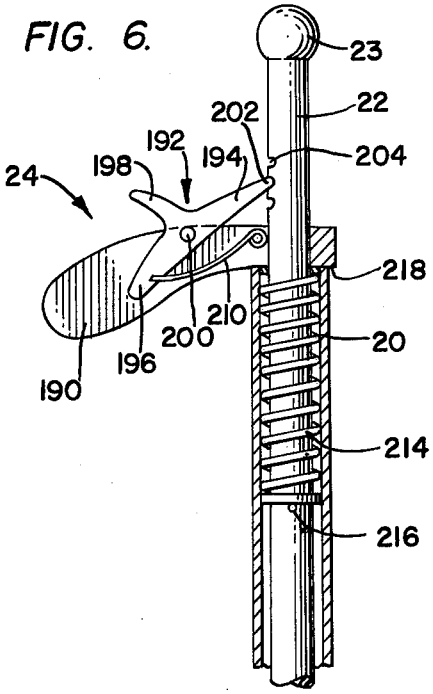
FIG. 6 is an elevation view of a control means for the device embodying the teachings of the present invention.

As best shown in FIG. 6, the control means 24 includes a handgrip 190 mounted on top of sleeve 20 and slidably receiving operating rod 22 therethrough. The control means also has a trigger mechanism 192 including a detent 194. The detent has a body portion 196 with a projecting finger 198 and which is pivotally mounted on handgrip 190 by a fastener 200 near the center of that body portion.

The operating rod extends outwardly of the sleeve at the upper end thereof, and the forward end of the detent body portion has a nose 202 which engages one of a plurality of notches 204 defined in the surface of the operating rod 22 located on the upper end thereof to be spaced apart longitudinally of the rod. The engagement between the nose 202 and one of the notches 204 locks that rod into a desired orientation with respect to the bracket 16. The plurality of notches enables the device to be opened to various degrees, even to the point of causing the blades to diverge outwardly away from each other at the bottom edges thereof. A leaf spring 210 is fastened at one end to the handgrip and has the other end engaged against the detent body portion at the rear end thereof to force that rear end clockwise about fastener 200, thereby forcing the nose 202 downward toward the sleeve 20. The nose 202 is released from engagement in a notch 204 by forcing the finger 198 in a counterclockwise direction with respect to the fastener 200 against the yielding resistance of the spring 210.

A coil spring 214 is mounted to be coaxial with and to surround the rod 22 and to have one end connected thereto via an abutment means, such as detent 216 located on the rod 22, and to have the other end engaged against bottom surface 218 of the handgrip 190 which forms the top of the sleeve 20. The spring 214 is maintained under compression to apply a continuous downwardly directed force to the rod, and thus bias same toward the bracket mounting arm 40 in the direction of arrow 220 in FIG. 4. The spring 214 therefore biases the operating rod toward a position wherein the blades 58 and 60 are tilted into the FIG. 4 orientation. The engagement between the trigger mechanism detent and the operating rod notches prevents movement of the rod into the FIG. 4 orientation, and the spring 210 maintains the detent in the engaged position.

Figure 4:
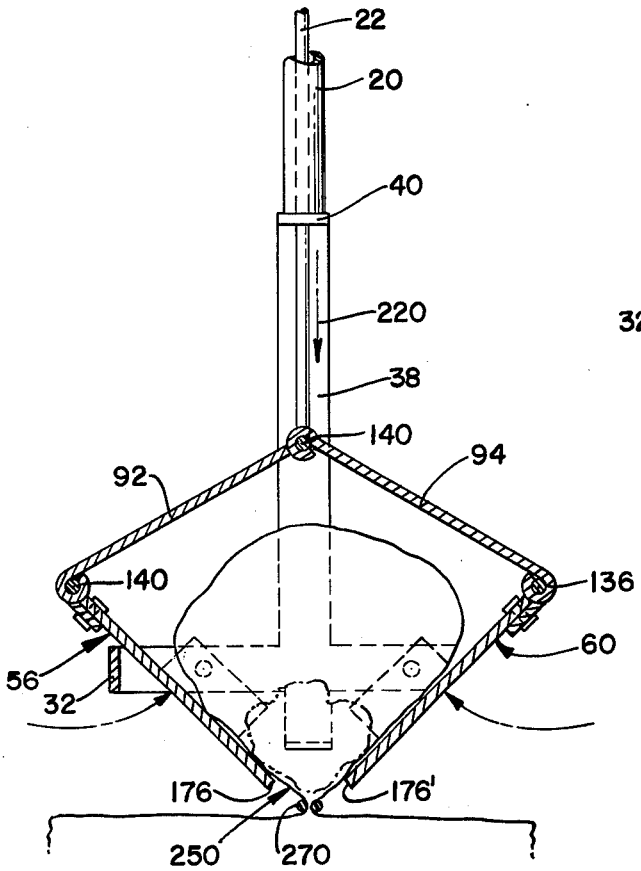
FIG. 4 is an elevation view of the device in the closed orientation.

The device in the cocked mode is shown in FIG. 1 and in the released, or pickup, mode in FIG. 4. When the trigger is actuated and the rod 22 is released, the spring 214 causes the operating rod to move downwardly with respect to bracket arm 40, thereby forcing the hinge downwardly causing arms 92 and 94 to move outwardly away from each other at the lower ends thereof, and the tops 88 and 90 of the blades to move away from each other. The pivotal connection of the blades to the frame 12 causes those blades to tilt with respect to each other into the closed orientation shown in FIG. 4 with the lower blade edges, such as edge 176, in contact with each other, or to be in close proximity with opposite edge 176' of the other blade, as shown in FIG. 4.

As best shown in FIG. 2, a sanitary, flexible wrapper or holding means 250 is releasably positioned within the pickup means 14 for use in holding, transporting and disposing of animal waste, or the like. The wrapper has a bottom 252 and a mouth section 254 and is oriented in the mouth-down orientation within the pickup means 14 and covers the inner surfaces 256 and 258 of the blades to prevent contact between those blades and the animal feces in order to maintain the device in a sanitary state.

The wrapper has a lip or marginal edge 262 which surrounds the mouth section thereof and which is folded back over the lower edges of the blades to form cuffs 264 and 266. The folded position of the wrapper orients the inner surface 268 thereof inwardly between the blades and outwardly on the outside thereof.

Once the device is actuated, the spring maintains the blades closed until the rod is forceably moved upward back into the cocked orientation, at which time the trigger mechanism is automatically reset through the action of the spring 210. The spring 214 is selected to exert sufficient force to close the blades when the lower edges of those blades are engaged against the surface of the ground so that a scooping action can be effected. The spring is also selected so that, in the extended position, with the blades closed, the blades will be maintained securely closed until the operating rod 22 is forceably returned to the cocked position. The spring is also strong enough to permit the blades to scrape a thin layer of soil up as they close in order to assure complete removal of the feces.

The wrapper can be any of several types of bags used in this art, such as plastic, cloth, or the like, and has compliant, impervious walls. The downwardly opening orientation of the wrapper permits the feces to be scooped into that wrapper when the blades move into the FIG. 4 closed orientation.

An elastomeric-like flexible retainer, such as rubber band 270, is positioned to surround the blades adjacent the notches, such as notches 164 and 164'. The rubber band is stretched to be taut on the blades and extends subjacent and in abutting contact with the cross member 50 of the bumper 44 when the blades are in the FIG. 2 open configuration. The curvature of the blade ends 170 and 172 can be selected so that there is a flat portion 272 adjacent each notch so that the band is seated on the flat portion adjacent the notches. Alternatively, the band can be stretched tight enough to maintain position without requiring the flat portions. The length of the flat portions can be selected so that the band 270 remains seated about the blades when the device is in the cocked orientation.

When the pickup blades move into the closed orientation, the lower edges 170 and 172 move toward each other and upward toward the frame 12 in an arc. The band 270 is stretched tight enough to remain positioned about the blades during the initial phase of a blade closing movement. Due to the upward movement of the blades, the band 270 is forced against cross member 50. The bumper member is immobile with respect to the frame, and hence the blade lower edges move out of the band as they continue to move upwardly with respect to the frame while the band is abuttingly held in position by the bumper cross member.

Figure 3:
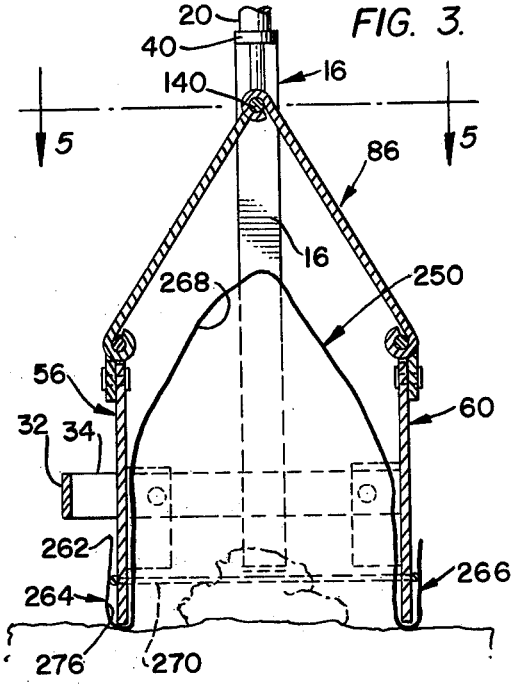
FIG. 3 is an elevation view taken along line 3—3 of FIG. 2.

As shown in FIG. 3, the band 270 is located inside the cuffs 264 and 266 and hence adjacent the outer surface 276 of the wrapper. As the blades close, the wrapper mouth is closed, and the band 270 is forced off of the blades. Band size and elasticity is selected so that the band closes the wrapper when that band moves off of the blades, and may even be pulled slightly outward of the blades during the closing process. The action of the rubber band upon contraction closes the mouth of the wrapper and also assists in scooping the feces throughout the peripheral area of the mouth of the wrapper upon closing. The length of cuffs 264 and 266, the flexibility of the wrapper, and the like, are selected so that the wrapper is freed from the blades and the band is selected to securely close the wrapper and maintain the wrapper closed once the device is actuated.

By positioning the wrapper to have cuffs, the blades are covered and never contact the ground or feces at any time. Thus, no element of the device ever contacts the feces, and the user never is required to contact any element that had such contact. The band pulls the wrapper down when the device is triggered, thus pulling that wrapper off of the blades and freeing same.

Operation of the device is evident from the above description and is shown in FIGS. 2–4. The device is cocked by pulling the knob 23 on the top of the operating rod upward to move the rod upward so that the blades are set into the parallel orientation shown in FIG. 2, the trigger automatically locks into a detaining position due to the action of spring 210 with the nose 202 seated in a notch 204. As shown in FIGS. 2 and 3, the band 270 is wrapped around the blades adjacent the notches 164 and 166 of both blades, and the wrapper is oriented in position with the pickup means 14 as shown in FIGS. 2 and 3. The mouth of the wrapper is folded back over both blades, and in the preferred embodiment, the cuff formed is approximately 3 inches long. The folded over mouth of the wrapper should pass the stretched band at notches 164 and 166. The bottom of the wrapper is left free and pushed back toward the hinge 86.

When both the band and the wrapper are properly placed, the blades can be opened wider by pulling the rod out farther and allowing the trigger nose to move into a lower notch. Opening the blades wider spreads the mouth of the wrapper wider and holds that wrapper in a tight fitting position.

The cocked device is oriented above the feces to be picked up with the blades straddling that feces to orient the wrapper in a pickup position, as shown in FIG. 2. The device is then held in a vertical orientation with respect to the ground and over the feces and then a lowering movement moves that unit until the blade lowermost edges contact the ground adjacent the feces, as shown in FIG. 3. The trigger is then released. If the feces is spread out, the unit may be used as a shovel to push the feces together to fit within the open mouth of the unit. The spring 214 causes the rod 22 to move downwardly, forcing the blades into the closed position shown in FIG. 4. The blades scrape along the ground and force the feces into the wrapper as shown in FIG. 4, the band abuts the bumper and the blades move out from within that band. The band snaps over the wrapper and closes the mouth of the wrapper with the feces contained within that wrapper.

The device is left closed until a suitable disposal unit is obtained, whereupon the device is actuated by pulling the rod 22 upwards, as by grasping the knob 23, until the trigger detains the rod by the nose 202 engaging a notch 204. The upward movement of the rod against the bias of the spring 214 pulls the hinge arms upwardly and hence toward each other to thereby pull the tops of the blades toward each other, and the blades are thus opened. As the wrapper is not attached to the device, that wrapper is released so that the securely closed wrapper can be placed into the disposal unit. Complete pickup and securely wrapped disposal is thus effected without ever requiring contact with either the feces or any element contacting that feces. The pickup and wrapped disposal is, therefore, sanitary and expeditious.

Figure 7:
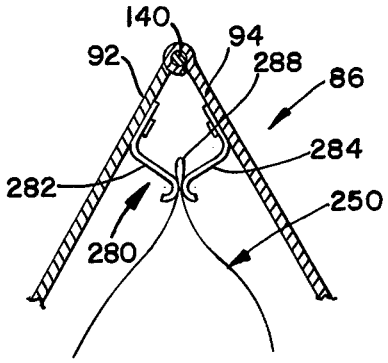
FIGS. 7 and 8 are elevation views of a wrapper clamping device used in conjunction with the device embodying the teachings of the present invention.
Figure 8:
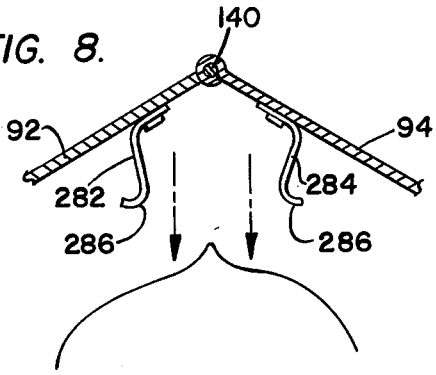

An alternative embodiment of the pickup device includes a wrapper clamp 280 shown in FIGS. 7 and 8. The wrapper clamp includes a pair of gripping prongs 282 and 284 each fastened at one end thereof to one arm of the hinge 86. The prongs each have a wrapper engaging section 286 on the free end thereof and are sized to securely clamp the wrapper bottom 288 therebetween when the pickup device is in the cocked orientation. The hinge arms 92 and 94 are in the cocked orientation in FIG. 7 and in the released orientation in FIG. 8. Using the alternative embodiment, the wrapper is securely held in the pickup device in the proper position to receive the feces. When the device is released, the band 270 snaps about the open mouth of that wrapper, pulling the wrapper downwardly as indicated by the arrows in FIG. 8. The weight of the wrapper also causes that wrapper to move in the direction of those arrows. Thus, upon reopening the unit, the wrapper end will not be retrapped between the arms of the clamp, as that wrapper will have move downward and away from the clamp. The clamp is most useful when large, or oversized, wrappers are used.

The unit can be produced in a variety of sizes to accommodate animals of various sizes, such as, for example, small, medium and large. The wrapper and band can be produced to fit the various unit sizes.

As this invention may be embodied in several forms without departing from the spirit or essential characteristics thereof, the present embodiment is, therefore, illustrative and not restrictive, since the scope of the invention is defined by the appended claims rather than the description preceding them, and all changes that fall within the metes and bounds of the claims or that form their functional as well as conjointly cooperative equivalents are, therefore, intended to be embraced by those claims.

I claim:

1. A portable device for picking up animal droppings and collecting those droppings into a wrapper comprising:

a frame;

a pair of blades pivotally mounted on said frame and each having side edges, an upper edge and a bottom edge;

a blade operating hinge having a pair of arms each having an upper edge and a lower edge with said lower edges each being hingeably connected to a blade top edge;

an operating rod hingeably connected to said hinge upper edges and being movably connected to said frame so that movement of said rod with respect to said frame causes said blade upper edges to move via movement of said hinge, said blades being mounted on said frame to be caused to tilt toward and away from each other by the movement of said upper edges; and a flexible band positioned to encircle said blades, said band being located adjacent said blade bottom edges to be moved off said blades when said blades are tilted to move said bottom edges toward each other to close the wrapper positioned between said blades.

2. The device of claim 1, further including a bumper attached to said frame to be in abutting contact with said band.

3. The device of claim 2, wherein said bumper includes an arm attached to said frame and a crosspiece attached to said arm and oriented to abut said band to cause said band to be moved off of said blades when said blade bottom edges are moved toward each other.

4. The device of claim 1, wherein said blades each have a notch defined in the side edges thereof adjacent said bottom edges.

5. The device of claim 4, wherein said blades each have an arcuate corner adjacent said bottom edge and said notch with said band being positioned on said blade bottom edge adjacent said notch.

6. The device of claim 1, further including a tubular sleeve mounted on said frame, said operating rod being received within said sleeve to be longitudinally slidable therewith and having a top portion extending out of said sleeve.

7. The device of claim 6, wherein said operating rod has a plurality of notches defined therein on said top portion, and further including a control means mounted on said sleeve and including a handgrip mounted on said sleeve, a detent pivotally attached to said handgrip, said detent engaging said notches to hold said operating rod in position, a first spring on said handgrip and engaging said detent to force said detent into engagement with said notches, and a second spring on said operating rod biasing said rod downwardly toward said frame.

8. The device of claim 1, further including a clamp on said hinge to hold the wrapper between said blades, said clamp releasing the wrapper when said hinge arms move apart.

9. The device of claim 1, wherein the wrapper is folded over said blade bottom edges and said band to prevent animal droppings from contacting said blades.

10. The device of claim 1, wherein said band comprises an elastomeric material.

* * * * *